US005441126A

United States Patent [19]

Orrick

[11] Patent Number: 5,441,126

[45] Date of Patent: Aug. 15, 1995

[54] LADDER GUARD

[76] Inventor: James Orrick, 17 Clinton Pl., Normal, Ill. 61761

[21] Appl. No.: 201,905

[22] Filed: Feb. 25, 1994

[51] Int. Cl.[6] ..... E06C 5/32

[52] U.S. Cl. ..... 182/106; 182/230

[58] Field of Search ..... 182/106, 129, 230

[56] References Cited

U.S. PATENT DOCUMENTS

| | | | |
|---|---|---|---|
| 2,880,829 | 4/1959 | Watkins | 182/106 |
| 3,225,863 | 6/1964 | Ludow | 182/104 |
| 3,311,195 | 10/1965 | Singer | 182/230 |
| 3,372,772 | 5/1966 | Singer | 182/230 |
| 3,603,428 | 9/1971 | Hanses | 182/222 X |
| 3,968,857 | 7/1976 | Bryan | 182/106 |
| 4,126,206 | 11/1978 | Becnel | 182/129 |
| 4,181,195 | 1/1980 | Clarke | 182/230 |
| 4,378,862 | 4/1983 | Carmel | 182/106 |
| 4,450,937 | 5/1984 | Broughton | 182/106 X |
| 4,579,197 | 4/1986 | Spurling | 182/230 X |

*Primary Examiner*—Alvin C. Chin-Shue

*Attorney, Agent, or Firm*—Juettner Pyle Lloyd & Piontek

[57] ABSTRACT

A ladder guard, when in placed on the front section of a two-section extension ladder, prevents persons from climbing on the ladder, from either the front or back, and reduces the chances of theft by preventing the ladder from being retracted. The ladder guard comprises a unitary, semi-rigid shell having a central panel portion and two channel portions to each side of the panel. The panel is recessed relative to the channels so that the panel may be drawn closely to the rungs. The channels extend around the side rails of the ladder. The shell may have a multiplicity of openings to allow wind to blow through the shell. The ladder guard includes a hook for engaging a rung of the ladder to support the guard, and an adjustable locking means for securely locking the ladder guard to the ladder. The ladder guard further comprises a member extending from the back of the shell a distance sufficient to engage the rungs of both ladder sections to prevent the ladder from being retracted when the ladder is set up in a backwards position.

13 Claims, 3 Drawing Sheets

16
14
16
24
10
12
24
UL
L
R
S
R
LL

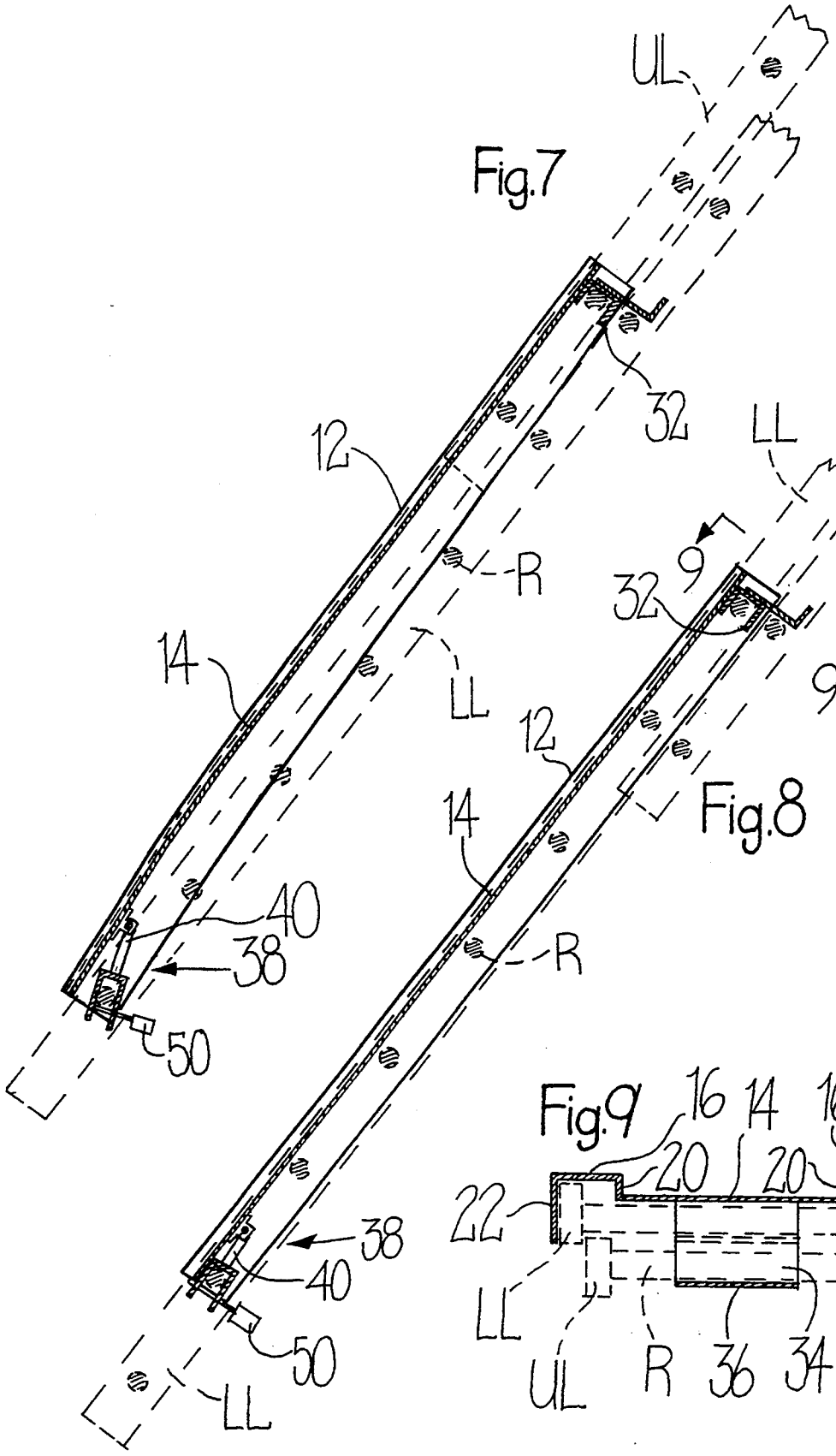
Fig.7
Fig.8
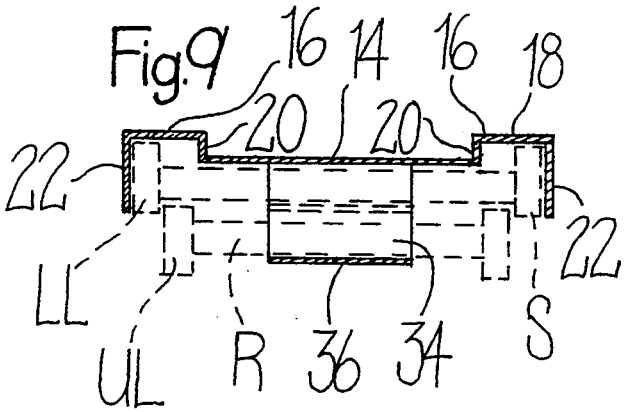
Fig.9

LADDER GUARD

INVENTION DISCLOSURE STATEMENT

The subject application is based on an invention disclosure statement filed by Applicant in the United States Patent and Trademark Office on Jan. 4, 1993 under Document No. 323,040.

BACKGROUND OF THE INVENTION

The present invention relates to ladder guards for the purpose of preventing people, particularly children from climbing a ladder. The invention is particularly directed to ladder guards for extension ladders. The invention also relates to security devices for deterring theft of ladders.

Ladder guards for preventing or deterring people from climbing ladders are well known in the art. U.S. Pat. Nos. 3,225,863 to Ludlow, 4,181,195 to Clarke, 4,450,937 to Broughton and 4,579,197 to Spurling are representative. The prior art guards typically comprise a flat, planner member that is secured to the ladder, covering the rungs of the ladder to prevent its use. However, these guards are not fully satisfactory, especially as applied to extension ladders.

Commercially available extension ladders have parallel, spaced apart side rails with a plurality of rungs extending between the side rails. The side rails have a depth that is greater than the depth or diameter of the rungs. Accordingly, conventional ladder guards that are flat and planar will engage the ladder side rails, leaving a space in between the back of the guard and the rungs. A guard of this type will hinder a person from climbing the front of the ladder. But, a person, especially a child, may nevertheless climb the ladder from the back or underside. Many conventional ladder guards, e.g., as in the Ludlow '863 patent, do not address this problem.

Applicant is unaware of any prior art ladder guards specifically applicable to conventional extension ladders. The above cited prior art ladder guards could not be successfully applied to commercial extension ladders for several reasons. One, the prior art guards are typically designed to fit only one ladder. They may not fit ladders of different sizes. In addition, the cited prior art ladder guards are all for single section ladders. These prior art ladder guards may be unsuitable for extension ladders that have multiple sections. Specifically, if the ladder guard is longer than the length of the unobstructed lower section, it may not be possible to install the ladder guard to the lower ladder section. The cited prior art does not attempt to solve problems incident to providing a guard for extension ladders.

Another problem in the art is the theft of ladders. Painting, siding, and general contractors often need to set up ladders with scaffolding therebetween. If the job extends for a period of several days or more, the contractor may leave the ladders and scaffolding in place to avoid the time and expense of disassembling, storing and locking the ladders. Due in part to the substantial value of quality ladders, theft has become a problem. Thieves may visit a job site during off work hours or at other times when the contractor and his crew are absent, disassemble the scaffolding, retract the ladders and abscond with the same.

For the foregoing reasons, there is need in the art for a ladder guard that prevents people, especially children, from climbing the ladder from the front or back, that is particularly suited for use on commercially available extension ladders, and that functions to deter theft of the ladder.

OBJECTS OF THE INVENTION

It is an object of the invention to provide a ladder guard that hinders the ability of persons to climb the ladder from both the front and back.

It is another object of the invention to provide a ladder guard that will fit all or nearly all conventional extension ladders.

It is yet another object of the invention to provide a ladder guard that will fit extension ladders whether the ladder is fully or partially extended.

It is a further object of the invention to provide a ladder guard that is easily installed, and which may be securely locked to the ladder.

It is a final object of the invention to provide a ladder guard that deters theft of the ladder.

SUMMARY OF THE INVENTION

In fulfillment of the objects of the invention, a ladder guard for installation onto an extension ladder is provided. Conventional extension ladders have spaced apart side rails and a plurality of rungs between the side rails. The ladder guard of the invention comprises a smooth, unitary, semi-rigid shell. The shell has a central, rectangular panel and a plurality of channels on each side of the panel. The shell is adapted so that the channels overly the ladder side rails and the panel overlies the ladder rungs. The panel is recessed relative to the channels. Thereby, the panel portion of the shell may be drawn into contact with or very closely adjacent to the rungs. The close fit of the panel to the rungs prevents a person from obtaining a hand or toe hold on the rungs from the back side of the ladder, thereby hindering persons from climbing the ladder from either the front or back.

The recess of the panel portion of the shell is accomplished by forming the side channels in a J-shaped cross-section. The J-shaped channel has a center portion and two leg portions of unequal length. The short leg portion joins the side edges of the panel. The long leg portion extends adjacent the outer side of the ladder side rails. Whereby the panel is recessed inwardly toward the ladder relative to the central portion of the channel portions such that said panel portion may be drawn closely to the rungs of the ladder.

The central panel has a width of about thirteen inches and each channel has a width of about three inches. In most commercial extension ladders, the side rails are spaced apart by thirteen inches or more. Accordingly, the panel of the invention will fit between the ladder side rails of all such ladders. The three inch width of each side channel is more than needed to accommodate a side rail, but provides sufficient space to accommodate ladders of different overall widths, i.e., from about 15 to about 19 inches in overall width. With these critical dimensions, it has been found that the ladder guard of the invention will fit nearly all commercially available extension ladders.

The length of the ladder guard is preferably about six feet. The six foot length has been found to be optimal for safety and ease of storage, transportation and assembly.

A hook is attached to the upper back surface of the shell. The hook extends from the panel portion of the shell and is adapted to engage a rung of the ladder. The hook engages the rung in a tight fit to draw the panel portion of the shell closely to the rungs.

A pivoting, adjustable locking means is attached to the lower back surface of the shell for locking the shell onto the ladder. The locking means comprises a pivoting arm. The arm can be adjusted to securely hold the shell to the ladder rungs. The arm can be locked to the ladder with an ordinary padlock.

Once the ladder guard of the invention is locked to an extension ladder, the ladder cannot be retracted. In a normal ladder set-up, the ladder guard is locked to the front surface of the ladder blocking the path for retraction of the upper ladder section. If one attempts to retract the ladder, the side rails of the upper ladder section will collide with the channel portions of the ladder guard, preventing any further retraction.

A special member is provided to prevent retraction of the ladder if the ladder is installed backwards. Although it is to be discouraged, occasionally a ladder gets installed backwards, that is with the upper ladder section being on the inward side of the lower section. The guard of the invention is equipped with a rearwardly extending member that extends between the ladder rungs and into the path of retraction of the upper ladder section. Thereby, the two ladder sections cannot be retracted even when the ladder is installed backwards.

Because the extension ladder cannot be retracted, a would be thief will have great physical difficulty in absconding with an extended ladder, which may well have a length of fifteen feet or more.

Further objects and advantages of the invention will become apparent from the following detailed description when read in conjunction with the accompanying drawings.

BRIEF DESCRIPTION OF THE DRAWINGS

FIG. 7 Is a longitudinal cross section of the ladder guard of the invention illustrating a second manner of installation onto an extension ladder.

FIG. 8 is a longitudinal cross section of the ladder guard of the invention illustrating a third manner of installation onto an extension ladder.

FIG. 9 is a transverse cross section of the ladder guard of the invention taken along line 9—9 of FIG. 8.

DETAILED DESCRIPTION

Figure 1:
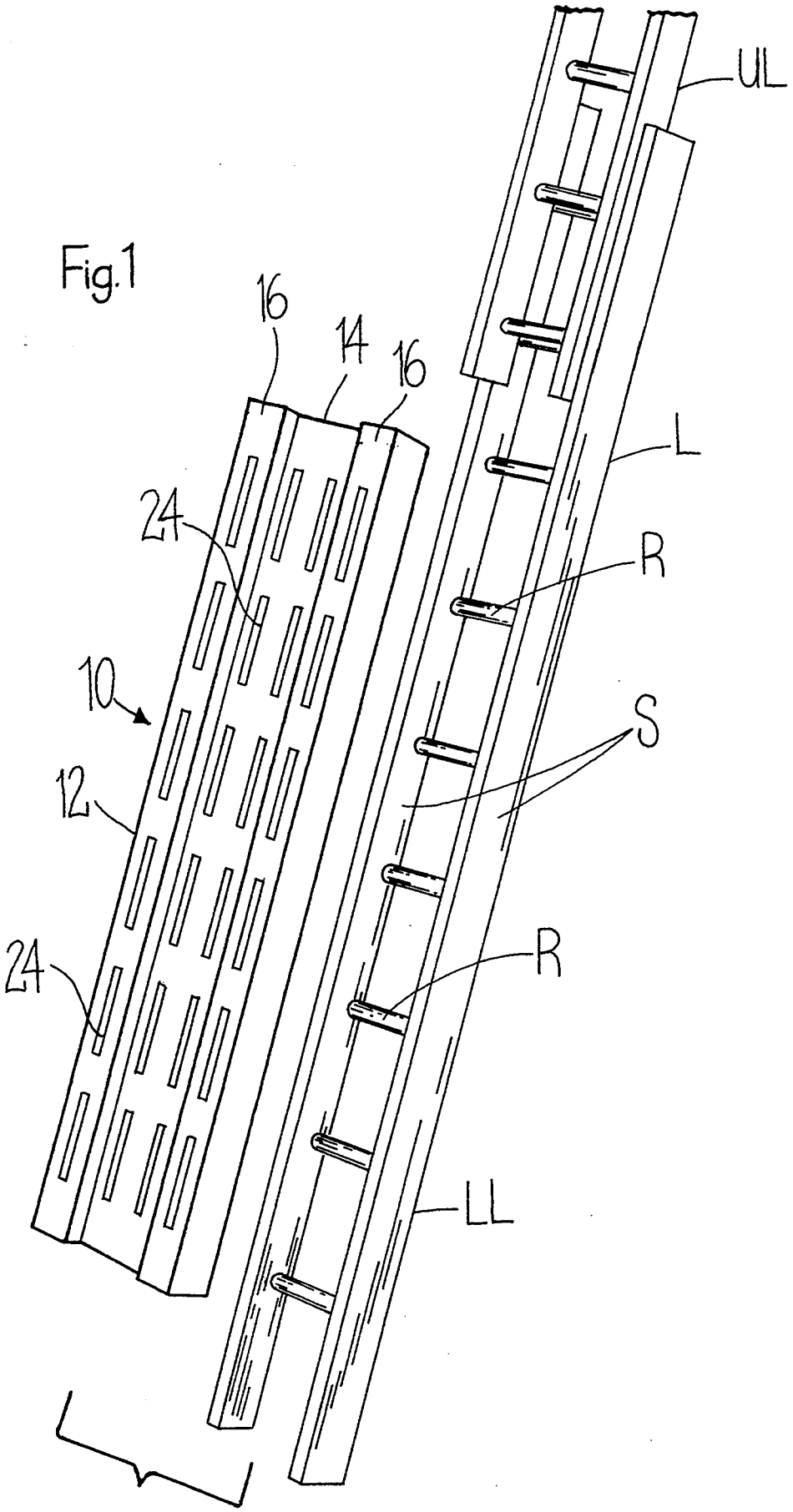
FIG. 1 is a perspective view of the ladder guard of the invention illustrating the preferred manner of installation onto an extension ladder.
Figure 2:
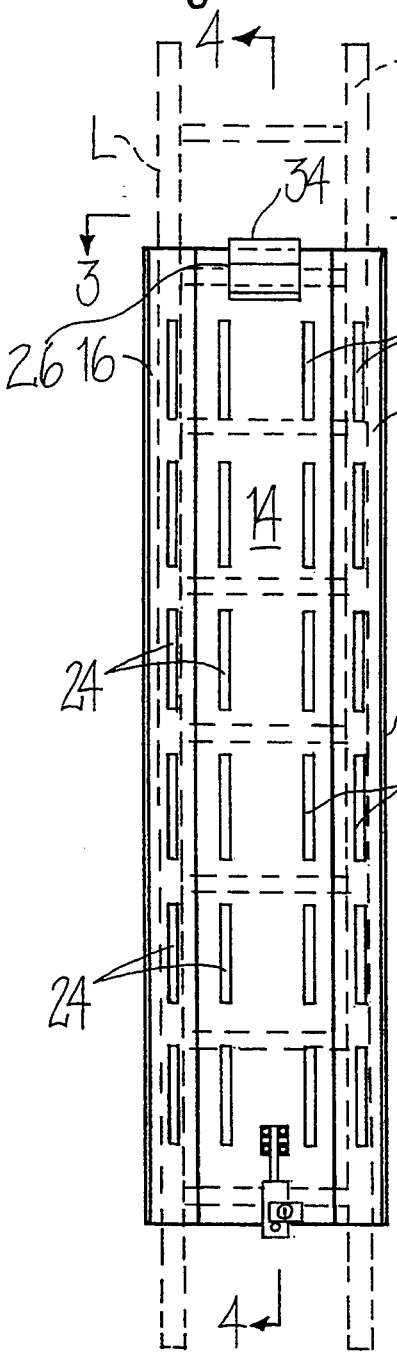
FIG. 2 is a back plan view of the ladder guard of the invention shown secured to a ladder.
Figure 4:
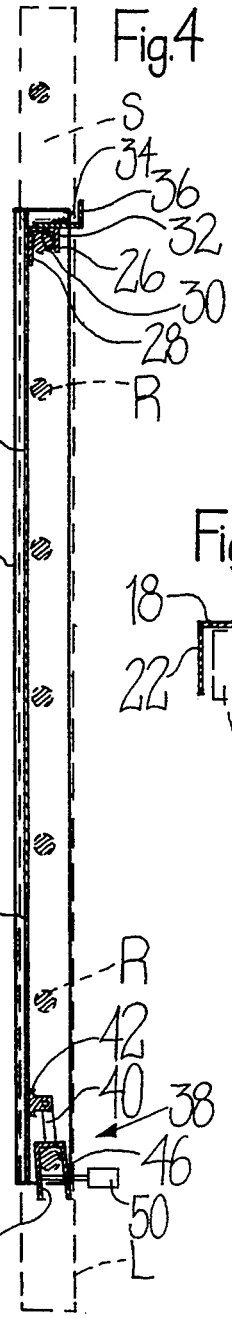
FIG. 4 is a longitudinal cross sectional view of the ladder guard of the invention taken along line 4—4 of FIG. 2.
Figure 5:
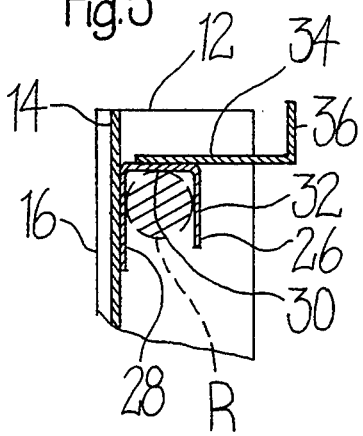
FIG. 5 is a enlarged longitudinal cross sectional view of the hook feature of the ladder guard of the invention.
Figure 3:
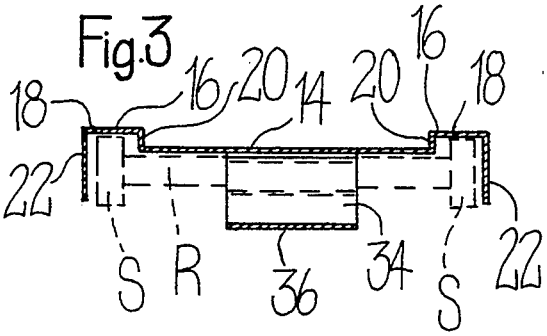
FIG. 3 is a transverse cross sectional view of the ladder guard of the invention taken along line 3—3 of FIG. 2.
Figure 6:
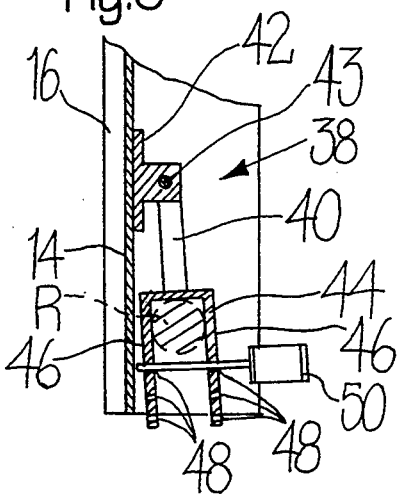
FIG. 6 is an enlarged longitudinal cross sectional view of the locking means of the ladder guard of the invention.

A ladder guard is shown generally at 10. The ladder guard is adapted to fit onto a ladder L having side rails S and rungs R as illustrated in FIG. 1. The ladder guard comprises a smooth, unitary, semi-rigid shell 12 having a panel 14 and side channels 16. The channels 16 partially surround the side rails S. Specifically, the channels 16 are J-shaped in cross section as best shown in FIG. 3. The J-shape comprises a center section 18, a short leg 20 and a long leg 22. The short leg 20 is joined to the panel portion 14. The long leg 22 extends over the ladder side rails S. The panel 14 is recessed inwardly toward the ladder relative to the center section 18. Thereby, the panel 14 is adapted to be positioned in contact with or closely adjacent the ladder rungs R, as best shown in FIG. 3. The close relationship of the panel 14 to the ladder rungs R hinders one from gaining a hand or toe hold on the ladder rungs and thereby deters people from climbing the ladder from the back.

The shell is preferably fabricated as a unitary piece of semi-rigid plastic, such as ABS plastic. The shell may be made by any conventional plastic molding process. Alternatively, the shell could be made from metal, such as aluminum. The shell is dimensioned so that one size will fit substantially all commercially available extension ladders. It has been determined that the critical dimensions for the ladder guard of the invention are a panel width of about thirteen inches, a side channel width of about 3 inches each, and a panel recess of about $\frac{3}{4}$ inch inwardly from the side channels 16. In most commercial extension ladders, the side rails are spaced apart by thirteen inches or more, such that the panel of the invention will fit in between, and will not ride onto, the ladder side rails. The three inch width of each side channel will accommodate ladders from about 15 to about 19 inches in overall width. With these critical dimensions, it has been found that the ladder guard of the invention will fit nearly all commercially available extension ladders.

The shell preferably includes a multiplicity of openings 24. The openings permit wind to blow through the guard thereby reducing the chance that the shell could act as a sail. It must be understood, however, that although the openings reduce the propensity of the ladder guard to catch the wind, the user of the ladder must exercise caution when erecting or maintaining a ladder or scaffolding under windy conditions. Under windy conditions, the ladder and scaffolding should either be broken down or secured with ropes or other appropriate tie down equipment. The ladder guard of the invention will not cure an improper installation under unsafe weather conditions.

The ladder guard further comprises a hook 26 attached to the shell 12. The hook is adapted to engage a ladder rung R and hold the shell tightly to the ladder. Preferably, the hook 26 is attached towards the top and in the center of the shell. The hook comprises a first portion 28 for attachment to the shell, a center portion 30 and a downwardly extending portion 32. The first portion 28 is attached to the shell by any conventional means, such as with a plurality of rivets. The downwardly extending portion 32 hooks over a rung R. The central portion 30 of the hook is dimensioned so that the hook tightly engages the ladder rung so that there will be minimal play in between the panel 14 and ladder rungs R. It has been determined that the central portion 30 of the hook should be about 2.25 inches to achieve the desired tight fit.

In the preferred embodiment, a member 34 extends in between and beyond the ladder rungs R. The member 34 prevents the ladder from being retracted when an extension ladder is erected in a backwards position, as more fully described below. Although not strictly necessary, member 34 includes a upturned portion 36 to assist in preventing the retraction of the ladder. The member 34 may be fabricated as a unitary piece with the hook 26. Alternatively, it may be a separate piece. The member 34 is connected to the shell, either by attachment to the hook or direct attachment to the shell.

Both the hook 26 and member 34 are preferably fabricated from the same plastic as the shell 12, but may be made from other materials such as metal.

Adjustable locking means for locking the shell to the ladder is shown generally at 38. The locking means comprises an pivoting or swivelling arm 40 which is pivotally connected at one end to the shell 12. The other end of the arm 40 engages a ladder rung R. The pivotal connection is formed with a base support 42. The base is firmly attached to the shell by conventional means, such as rivets. The base 42 and arm 40 are pivotally connected as illustrated at 43. The other end of the arm comprises a fork 44. The fork 44 has two tines 46, whereby a rung R is received in between the tines. The tines 46 are provided with at least one, preferably three pairs of holes 48. The holes through the tines are aligned to receive an ordinary padlock 50. The purpose of three sets of holes 48 is to allow for adjustment to achieve a tight, locking fit between the panel 12 and ladder rungs R. The locking means 38 is preferably fabricated by conventional techniques from metal, such as steel or aluminum.

The hook means 26 and locking means 38 cooperate to firmly and securely hold the panel 12 of the shell closely to the ladder rungs to hinder the ability of a person to gain finger or toe holds on the rungs and thereby deter persons from climbing the ladder from the rear.

The ladder guard of the invention may be installed on a multi-section extension ladder in essentially three ways. The preferred mode of installation is to attach the ladder guard to the lower ladder section below the upper section, as illustrated in FIG. 1. When installed, upper section of the ladder cannot be retracted because the ladder guard of the invention blocks the path need for retracting the upper section.

The second mode of installation is shown in FIG. 7. If the extension ladder is extended only a fraction of its overall capability, there may be inadequate unobstructed length on the lower ladder section on which to install the ladder guard of the invention. In this event, the hook 26 may be engaged on a rung of the upper ladder section UL. Because the shell 12 is fabricated from semi-rigid material, the shell may be bent or warped as necessary to engage the locking means with a rung on the lower ladder section LL. Since the locking means 38 is adjustable, a reasonable tight fit can still be obtained.

The final mode of installation is not preferred, but can be accommodated with the ladder guard of the invention. Occasionally, a person will improperly install a ladder backwards as depicted in FIGS. 8 and 9. Note that in FIGS. 8 and 9, the upper ladder section UL is to the inside of the lower section LL. Although the ladder is installed improperly, the ladder guard of the invention may still be effectively utilized. The hook 26 is engaged on the lower section—what should be the back side of the lower section. The locking means 38 is engaged with a rung on the lower section LL. In this mode, the member 34 extends in between ladder rungs to a position in line to catch a rung of the upper ladder section UL, should one attempt to retract the ladder. Thereby, member 34 the ladder guard of the invention prevents retraction of the ladder in the event that the ladder is improperly installed backwards.

The objects and advantages of the invention have thus been shown to be attained in a convenient, economical and facile manner. While the preferred embodiment of the invention has been shown and described, it is to be understood that various modifications and changes may be made thereto without departing from the scope of the invention as defined by the appended claims.

What is claimed is:

1. A ladder guard for a ladder, the ladder having spaced apart side rails and a plurality of rungs between the side rails, the ladder guard comprising:

(a) a shell, said shell having a pair of channels and a flat panel connected to and extending in between said channels, said shell not extending laterally beyond said channels, said panel adapted to be placed juxtaposed to the rungs and in between the side rails of the ladder, said panel being recessed inwardly relative to said channels, whereby said panel is adapted to be drawn closely to the rungs of the ladder, each said channel being adapted to partially surround a respective side rail of the ladder;

(b) means attached to said shell and adapted for holding said shell to the ladder; and (c) locking means for locking said shell onto the ladder, said locking means having an arm connected to said shell and adapted to engage the ladder and a lock attached to said arm.

2. A ladder guard as in claim 1, wherein each said channel is J-shaped in cross-section, having a short leg portion, a long leg portion and a center portion therebetween, said short leg portion joining the side edges of said panel, and said long leg portion adapted to extend adjacent the side rails of the ladder.

3. A ladder guard as in claim 1, wherein said panel has a width between said channels of about thirteen inches, and said channels each have a width of about three inches.

4. A ladder guard as in claim 1, wherein said shell is a unitary piece of semi-rigid plastic.

5. A ladder guard as in claim 1, wherein said shell has a multiplicity of openings for materially reducing the wind resistance of said shell.

6. A ladder guard as in claim 1, wherein said means adapted for holding said shell to the ladder comprises a hook attached to said shell and extending rearwardly from said shell, said hook adapted to engage a rung of the ladder.

7. A ladder guard as in claim 1, said ladder guard for installation onto a two section extension ladder, the ladder sections capable of being retracted relative to one another, each ladder section having side rails and rungs therebetween, the rungs of a first ladder section and the rungs of a second ladder section lying in separate planes which planes are parallel to and spaced apart one from the other, said ladder guard further comprising a member connected to said shell and extending in a direction substantially normal to said flat panel and adapted to intersect the planes of the rungs of both ladder sections to prevent the ladder from being retracted.

8. A ladder guard as in claim 7 wherein said means adapted for holding said shell to the ladder comprises a hook attached to said shell and extending rearwardly from said shell, said hook adapted to engage a rung of the ladder, and said member is attached to said hook.

9. A ladder guard as in claim 1, wherein said locking means further comprises a base attached to said shell, said arm pivotally connected at one end to said base and the other end of said arm adapted to engage a rung of the ladder, and said lock engaged with said other end of said arm and adapted for locking said arm to the ladder rung.

10. A ladder guard for a ladder, the ladder having spaced apart side rails and a plurality of rungs between the side rails, the ladder guard comprising:

(a) a unitary semi-rigid shell, said shell having two channels and a flat panel extending between said channels, said shell not extending laterally beyond said channels, said panel adapted to be placed juxtaposed to the rungs and in between the side rails of the ladder, each said channel being J-shaped in cross-section, having a short leg portion, a long leg portion and a center portion therebetween, said short leg portion joining the side edges of said panel, and said long leg portion adapted to extend adjacent the outer side of the side rails of the ladder, whereby said panel is recessed inwardly relative to the central portion of said channels such that said panel portion is adapted to be drawn closely to the rungs of the ladder;

(b) a hook attached to and extending from said panel portion of said shell and adapted to engage a rung of the ladder; and (c) locking means attached to said shell and adapted for locking said shell onto the ladder.

11. A combination ladder guard and extension ladder, comprising (a) an extension ladder having at least two sections, each said section having spaced apart side rails and a plurality of rungs between the side rails, the rungs of each said ladder section lying in separate planes which planes are parallel to and spaced apart one from the other, said ladder sections being retractable relative to one another;

(b) a panel adapted to placed against the rungs and in between the side rails of at least one said section of said extension ladder;

(c) engaging means attached to said panel and engaging the rungs of said extension ladder for holding said panel against the rungs of said extension ladder;

(d) locking means attached to said panel and locking said panel onto said extension ladder for deterring unauthorized removal of said panel; and (e) a member connected to said panel, said member extending in between the rungs of said two ladder sections and intersecting said planes of rungs of at least two of said ladder sections to prevent said extension ladder from being retracted.

12. A combination ladder guard and extension ladder as in claim 11, further comprising plural channels attached respectively to the sides of said panel, each said channel partially surrounding a respective side rail of at least one section of said extension ladder, and said panel being recessed inwardly toward said ladder relative to said channels.

13. A combination ladder guard and extension ladder as in claim 11, wherein said panel has a width of about thirteen inches and fits in between the side rails of at least one section of said extension ladder.

* * * * *